US011085434B2

(12) United States Patent
Takahashi et al.

(10) Patent No.: US 11,085,434 B2
(45) Date of Patent: Aug. 10, 2021

(54) LIQUID PUMP

(71) Applicant: NITTO KOHKI CO., LTD., Tokyo (JP)

(72) Inventors: Tomoaki Takahashi, Tokyo (JP); Yasumasa Ooki, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 28 days.

(21) Appl. No.: 16/395,411

(22) Filed: Apr. 26, 2019

(65) Prior Publication Data

US 2019/0249656 A1 Aug. 15, 2019

Related U.S. Application Data

(63) Continuation of application No. PCT/JP2017/037688, filed on Oct. 18, 2017.

(30) Foreign Application Priority Data

Oct. 27, 2016 (JP) ..... JP2016-210942

(51) Int. Cl.
*F04B 43/04* (2006.01)

(52) U.S. Cl.
CPC ..... *F04B 43/043* (2013.01); *F04B 43/04* (2013.01); *F04B 43/046* (2013.01)

(58) Field of Classification Search
CPC ..... F04B 43/043; F04B 43/046; F04B 43/04; F04B 43/0009; F04B 17/003; F04B 53/16; F04B 53/005
See application file for complete search history.

(56) References Cited

U.S. PATENT DOCUMENTS 2,287,841 A * 6/1942 Tabb ..... F04B 9/14 92/94
2,351,304 A * 6/1944 Tabb ..... F04B 11/0016 417/435

(Continued)

FOREIGN PATENT DOCUMENTS

JP S62214287 9/1987
JP S63046680 3/1988

(Continued)

OTHER PUBLICATIONS

International Search Report for International Application PCT/JP2017/037688, dated Dec. 26, 2017.

*Primary Examiner* — Devon C Kramer
*Assistant Examiner* — Thomas Fink
(74) *Attorney, Agent, or Firm* — Burris Law, PLLC

(57) ABSTRACT

Provided is a liquid pump configured to suppress discharge of air from an air pool formed in a discharge-side tank. A discharge-side tank part formed in a housing has a first inner wall surface and a second inner wall surface facing each other in a horizontal direction in an installed position of the liquid pump. The first inner wall surface is formed with a discharge port, and the second inner wall surface is formed with an opening of a discharge-side communicating passage. An air pool is formed in a space in the discharge-side tank part above the opening of the discharge-side communicating passage and the discharge port. A circular cylindrical partition is provided in the discharge-side tank part. The circular cylindrical partition projects from the second inner wall surface toward the first inner wall surface with at least a portion of the cylindrical partition positioned above the opening of the discharge-side communicating passage so as to cover the opening as seen from the air pool side.

18 Claims, 4 Drawing Sheets

(56) References Cited

U.S. PATENT DOCUMENTS 2,405,466 A * 8/1946 Tabb ..... F04B 11/0016 417/307
2,834,299 A * 5/1958 Coffey ..... F02M 59/14 417/572
3,467,020 A * 9/1969 Russell ..... F04B 11/0016 417/542
4,536,139 A * 8/1985 Greco ..... F02M 37/046 285/921
6,116,866 A * 9/2000 Tomita ..... F04B 53/105 137/855
2005/0126649 A1* 6/2005 Onishi ..... F04B 53/1065 137/854
2007/0035213 A1* 2/2007 Nakajima ..... F04B 43/046 310/348
2007/0138914 A1* 6/2007 Ishikawa ..... F04B 43/04 310/328
2008/0095651 A1* 4/2008 Onishi ..... F04B 43/04 417/558
2008/0101965 A1* 5/2008 Zhang ..... F25B 9/14 417/413.2
2008/0170951 A1* 7/2008 Satoh ..... F04B 43/04 417/413.2
2008/0199332 A1* 8/2008 Satoh ..... H01L 41/0973 417/413.2
2009/0162224 A1* 6/2009 Wakabayashi ..... F04B 43/046 417/410.2
2011/0006127 A1* 1/2011 Ono ..... B05B 17/0607 239/1
2011/0103980 A1* 5/2011 Mandica ..... F04B 43/046 417/413.2
2014/0023533 A1* 1/2014 Ishii ..... F04B 45/047 417/413.1
2014/0271274 A1* 9/2014 Ishii ..... F04B 45/047 417/413.1
2015/0198151 A1* 7/2015 Kim ..... F04B 43/046 417/413.2
2018/0142684 A1* 5/2018 Abel ..... F04B 43/026
2018/0343924 A1* 12/2018 Lin ..... F04B 53/16
2019/0192017 A1* 6/2019 Susi ..... A61B 5/02141

FOREIGN PATENT DOCUMENTS

JP H02055881 2/1990
JP H02094382 7/1990
JP H104034477 3/1992
JP H104017828 4/1992
JP 2835519 12/1998
JP 2003003962 1/2003
JP 4392634 1/2010
JP 2010196492 A * 9/2010

* cited by examiner

LIQUID PUMP

CROSS-REFERENCE TO RELATED APPLICATIONS

This application is a continuation of International Application No. PCT/JP2017/037688, filed on Oct. 18, 2017, which claims priority to and the benefit of JP 2016-210942 filed on Oct. 27, 2016. The disclosures of the above applications are incorporated herein by reference.

FIELD

The present disclosure relates to a liquid pump configured to suck a liquid from a suction port and to discharge the liquid from a discharge port by periodically expanding and contracting the volume of a pump chamber.

BACKGROUND

Among liquid pumps for transferring liquids such as water or chemicals, there is one configured to suck a liquid from a suction port and to discharge the liquid from a discharge port by vibrating a part of a wall defining a pump chamber to dynamically change the volume of the pump chamber. For example, Patent Literature 1 referred to below discloses a liquid pump in which a stacked diaphragm vibrator (bimorph vibrator) comprising two mutually bonded piezoelectric elements is disposed as a part of a wall of a pump chamber, and in which the diaphragm vibrator is vibrated by applying an alternating-current voltage thereto, thereby alternately expanding and contracting the volume of the pump chamber and thus transferring liquid. In this liquid pump, check valves are disposed respectively between a suction port sucking a liquid and the pump chamber, and between a discharge port discharging the liquid and the pump chamber. When the pump chamber expands, the liquid is sucked into the pump chamber from the suction port through the suction port-side check valve, and when the pump chamber contracts, the liquid in the pump chamber is discharged from the discharge port through the discharge port-side check valve.

In the above-described liquid pump, when the liquid is to be discharged from the pump chamber, the pump chamber contracts to pressurize the inside of the pump chamber, thereby allowing the liquid to be delivered from the inside of the pump chamber toward the discharge port. In this regard, however, if the fluid resistance at the discharge port side is large, a sufficient amount of liquid cannot be discharged from the pump chamber. A similar phenomenon occurs also when the liquid is sucked into the pump chamber. When the fluid resistance at the suction port side is large, a sufficient amount of liquid cannot be sucked into the pump chamber. That is, the pump performance is degraded with an increase in the fluid resistance at the discharge port and the suction port. A conventional solution to this problem is to provide reservoir tanks at the suction and discharge port sides, respectively, and to form an air pool over the fluid in each of the tanks (Patent Literature 2). Owing to the provision of the tanks having air pools formed therein, when the liquid is to be sucked, the air in the suction port-side tank temporarily expands, thereby decreasing the resistance when the fluid is sucked into the pump chamber from the suction port-side tank. When the liquid is to be discharged, the air in the discharge port-side tank temporarily contracts, thereby decreasing the resistance when the fluid is delivered into the discharge port-side tank from the pump chamber.

Consequently, even if the fluid resistance at the suction and discharge ports increases, it is possible to suppress degradation of the pump performance due to the increase in the fluid resistance.

CITATION LIST

Patent Literature

Patent Literature 1: Japanese Utility Model Registration Application Publication No. Hei 2-94382

Patent Literature 2: Japanese Patent Application Publication No. Sho 62-214287

SUMMARY

Technical Problem

The above-described liquid pump is usually configured to be capable of changing the discharge quantity of liquid by changing the vibration frequency of the vibrator. However, if the vibration frequency is increased in order to increase the discharge quantity, bubbles containing air in the air pool may be formed particularly in the discharge port-side tank in the vicinity of the liquid surface in the tank by vibration propagating through the liquid, and the air that forms bubbles may diffuse into the liquid and may be discharged from the discharge port, together with the liquid. In such a case, the air pool gradually decreases in size, which reduces the effect of reducing the influence of the fluid resistance. As a result, it becomes impossible to maintain the discharge performance of the pump undesirably.

Accordingly, an object of the present invention is to provide a liquid pump configured to suppress discharge of air from an air pool formed in a discharge port-side tank.

Solution to Problem

That is, an object of the present invention is to provide a liquid pump including a suction port sucking a liquid; a pump chamber communicating with the suction port, the pump chamber being defined by a wall, a part of which is a vibrating wall part vibratable to dynamically change the volume of the pump chamber; a discharge-side communicating passage extending from the pump chamber; a discharge-side tank part communicating with the pump chamber through the discharge-side communicating passage to store the liquid delivered from the pump chamber; a discharge-side check valve disposed between the discharge-side tank part and the pump chamber to allow passage of fluid therethrough from the pump chamber toward the discharge-side tank part but prevent passage of fluid therethrough from the discharge-side tank part toward the pump chamber; and a discharge port discharging the liquid from the discharge-side tank part. The liquid pump is configured to suck the liquid from the suction port and to discharge the liquid from the discharge port in response to vibration of the vibrating wall part. The discharge-side tank part has a first inner wall surface and a second inner wall surface facing each other in a horizontal direction in an installed position of the liquid pump. The first inner wall surface is formed with the discharge port, and the second inner wall surface is formed with an open end of the discharge-side communicating passage. The discharge-side tank part is configured such that an air pool is formed in a space in the discharge-side tank part above the open end of the discharge-side communicating passage and the discharge port. The liquid pump further includes a partition projecting from the second inner wall surface toward the first inner wall surface in the discharge-side tank part at least at a position above the open end of the discharge-side communicating passage so as to cover the open end as seen from the air pool side.

In the liquid pump, the partition is provided in the discharge-side tank part between the open end of the discharge-side communicating passage and the air pool. Therefore, even if bubbles containing air in the air pool are formed in the vicinity of the liquid surface in the discharge-side tank part, it is unlikely that the air will diffuse downward. Consequently, it is possible to suppress discharge of air from the discharge port.

Specifically, a gap may be provided between the partition and the first inner wall surface.

More specifically, the partition may be a cylindrical partition projecting from the second inner wall surface so as to surround the open end of the discharge-side communicating passage.

Preferably, the open end of the discharge-side communicating passage and the discharge port may be disposed below the center position in the vertical direction of the discharge-side tank part.

With the above-described configuration, the space in the discharge-side tank part above the discharge port and the discharge-side communicating passage becomes larger, and the air pool can be made larger. In addition, the distance between the air pool and the discharge port can be increased, so that it is possible to suppress discharge of air from the discharge port even more reliably.

More specifically, the arrangement may be as follows. The liquid pump further includes a housing comprising a first housing part, a second housing part, and a third housing part, which are each formed in a plate-like shape as a whole. The first housing part, the second housing part, and the third housing part are stacked on top of each other in such a manner that the second housing part is sandwiched between the first housing part and the third housing part. The first housing part has the suction port and the discharge port and further has a first discharge-side tank recess having a bottom surface defined by the first inner wall surface, the first discharge-side tank recess being open toward the second housing part. The second housing part has a second discharge-side tank recess having a bottom surface defined by the second inner wall surface, the second discharge-side tank recess being open toward the first housing part. The second housing part further has a pump chamber recess on a side thereof opposite to a side having the second discharge-side tank recess, the pump chamber recess being open toward the third housing part. The vibrating wall part is a diaphragm vibrator held between the second housing part and the third housing part so as to cover an opening portion of the pump chamber recess. The discharge-side tank part is formed by the first discharge-side tank recess and the second discharge-side tank recess.

Preferably, the liquid pump may further include a suction-side tank part disposed between the suction port and the pump chamber to store the liquid sucked from the suction port; a suction-side communicating passage providing communication between the suction-side tank part and the pump chamber; and a suction-side check valve disposed to cover an open end of the suction-side communicating passage open to the pump chamber from the pump chamber side, the suction-side check valve being configured to allow passage of fluid therethrough from the suction-side tank part toward the pump chamber but prevent passage of fluid therethrough from the pump chamber toward the suction-side tank part. The suction-side tank part has a first inner wall surface and a second inner wall surface facing each other in the horizontal direction in the installed position of the liquid pump. The first inner wall surface of the suction-side tank part is formed with the suction port, and the second inner wall surface of the suction-side tank part is formed with an open end of the suction-side communicating passage open to the suction-side tank part. The suction-side tank part is configured such that an air pool is formed in a space in the suction-side tank part above the opening and the suction port. The liquid pump further includes a partition projecting from the second inner wall surface of the suction-side tank part toward the first inner wall surface of the suction-side tank part at least at a position above the open end in the suction-side tank part so as to cover the open end in the suction-side tank part as seen from the air pool side.

By providing the suction-side tank part, it becomes possible to stabilize also the suction capacity of the liquid pump. In addition, by providing the partition also in the suction-side tank part, it becomes possible to prevent the air in the suction-side tank part from being sucked into the pump chamber.

Embodiments of a liquid pump according to the present invention will be explained below on the basis of the accompanying drawings.

DRAWINGS

DETAILED DESCRIPTION

Figure 1:
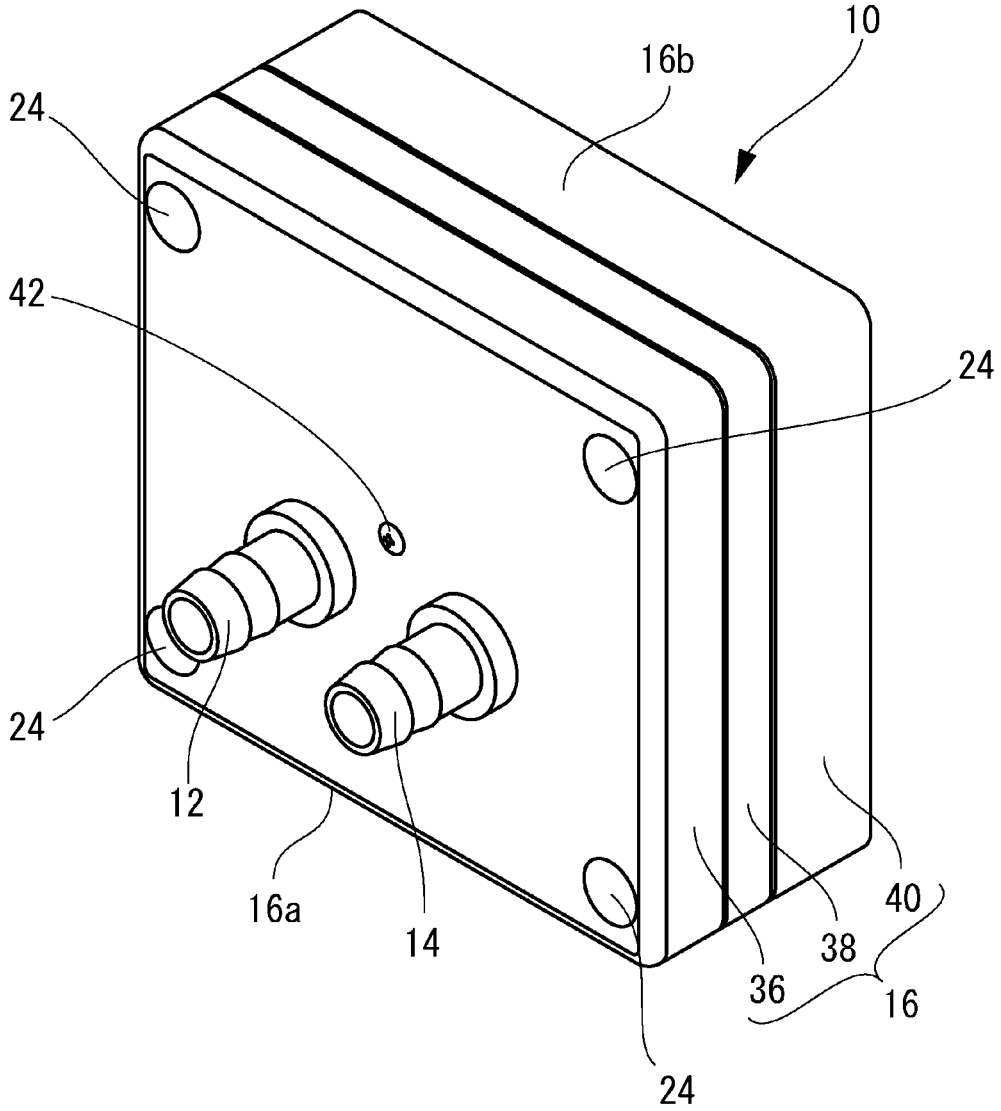
FIG. 1 is a perspective view of a liquid pump according to an embodiment of the present invention.
Figure 2:
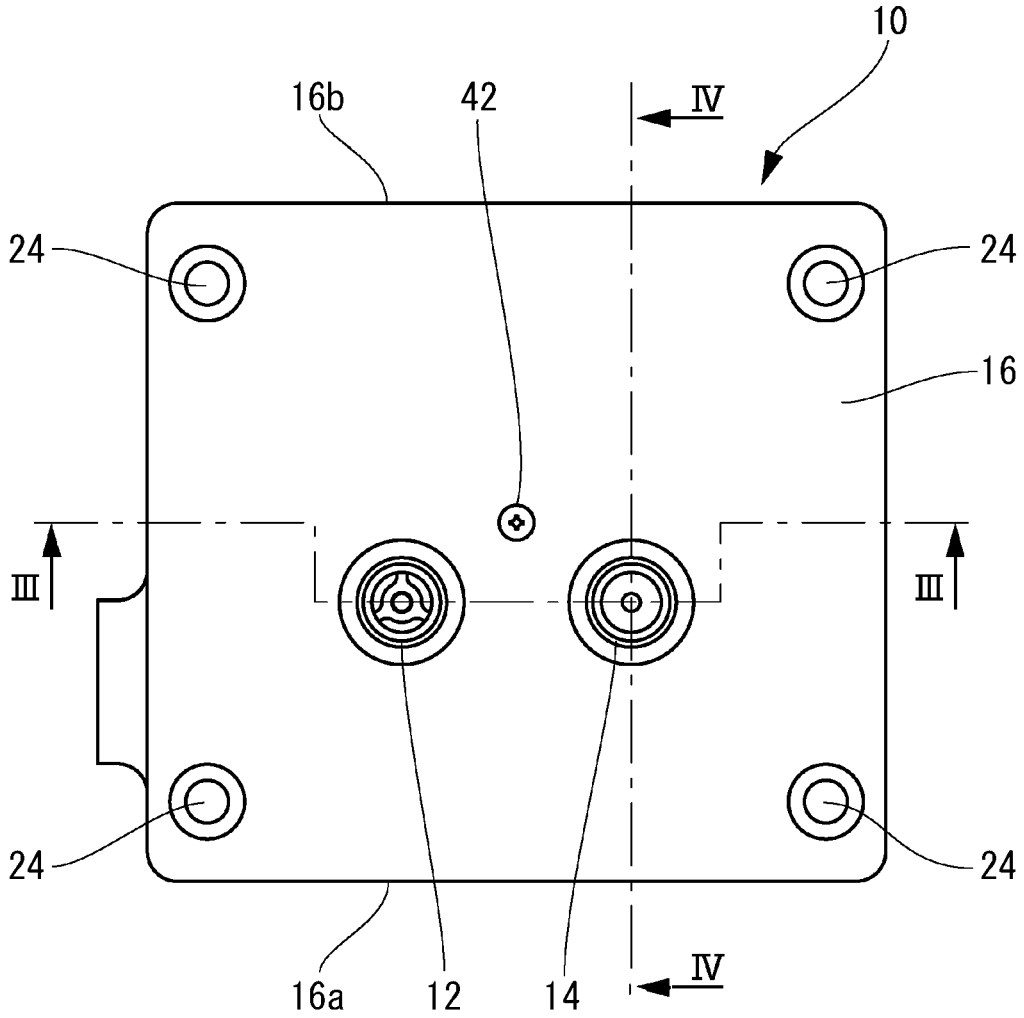
FIG. 2 is a front view of the liquid pump shown in FIG. 1.
Figure 3:
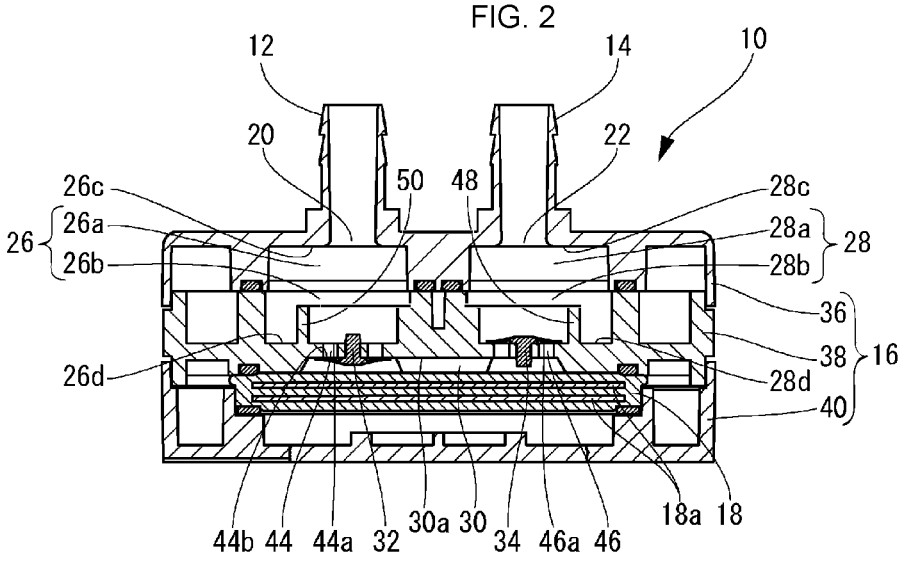
FIG. 3 is a sectional view taken along the line III-III in FIG. 2.

A liquid pump 10 according an embodiment of the present invention includes, as shown in FIGS. 1 and 2, a housing 16 having a suction nozzle 12 for attaching a suction-side tube (not shown), and a discharge nozzle 14 for attaching a discharge-side tube (not shown). In the housing 16 is disposed, as shown in FIG. 3, a diaphragm vibrator 18 having two piezoelectric elements. By applying an alternating-current voltage to the piezoelectric elements, the diaphragm vibrator 18 is periodically vibrated to suck a liquid from a suction port 20 of the suction nozzle 12 and to discharge the liquid from a discharge port 22 of the discharge nozzle 14, as will be described later. The liquid pump 10 is attached to another device or the like with screws (not shown) inserted through four screw mounting holes 24, respectively, formed in the housing 16. The liquid pump 10 is installed in a posture shown in FIGS. 1 and 2 in which a bottom surface 16*a* of the housing 16 faces downward, and a top surface 16*b* of the housing 16 faces upward. The term "installed position" as used in this specification means a position in which the liquid pump 10 is installed in the above-described posture.

Figure 4:
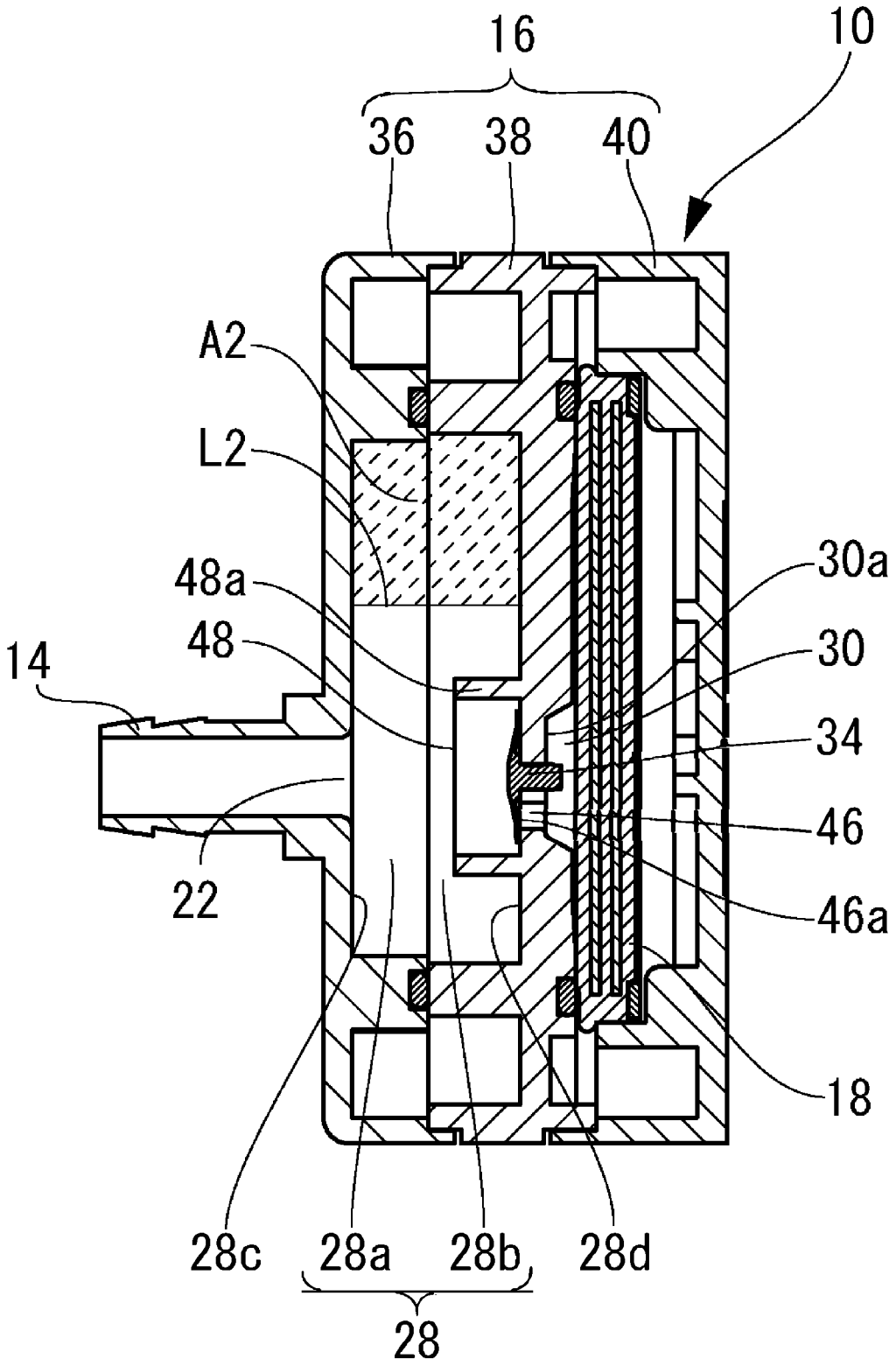
FIG. 4 is a sectional view taken along the line IV-IV in FIG. 2.

As shown in FIG. 3, the housing 16 is formed therein with a suction-side tank part 26 communicating with the suction port 20, a discharge-side tank part 28 communicating with the discharge port 22, and a pump chamber 30 communicating with the suction-side tank part 26 and the discharge-side tank part 28. Between the suction-side tank part 26 and the pump chamber 30 is disposed a suction-side check valve 32. The suction-side check valve 32 is configured to allow passage of fluid therethrough from the suction-side tank part 26 toward the pump chamber 30 but prevent passage of fluid therethrough in the reverse direction. Similarly, a discharge-side check valve 34 is disposed between the discharge-side tank part 28 and the pump chamber 30. The discharge-side check valve 34 is configured to allow passage of fluid therethrough from the pump chamber 30 toward the discharge-side tank part 28 but prevent passage of fluid therethrough in the reverse direction. A part of a wall constituting the pump chamber 30 is formed by the diaphragm vibrator 18. The diaphragm vibrator 18 is configured as follows. Upon application of a voltage to piezoelectric elements 18*a*, the diaphragm vibrator 18 bends in a direction depending on the polarity of the voltage. Thus, the diaphragm vibrator 18 functions as a vibrating wall part which, upon application of a periodic voltage thereto, bends and vibrates in the horizontal direction (up-down direction in FIG. 3; left-right direction in FIG. 4) in the installed position of the liquid pump 10 according to the period of the applied voltage. In response to the vibration of the diaphragm vibrator 18, the volume of the pump chamber 30 expands and contracts repeatedly and periodically. When the diaphragm vibrator 18 bends rightward as seen in FIG. 4 and consequently the volume of the pump chamber 30 expands, the pressure in the pump chamber 30 decreases, and the suction-side check valve 32 opens, thereby allowing the liquid in the suction-side tank part 26 to be drawn into the pump chamber 30. At this time, the discharge-side check valve 34 is kept closed; therefore, no liquid flows into the pump chamber 30 from the discharge-side tank part 28. Next, when the diaphragm vibrator 18 bends leftward as seen in FIG. 4 and consequently the volume of the pump chamber 30 contracts, the pressure in the pump chamber 30 increases, and the discharge-side check valve 34 opens, thereby allowing the liquid in the pump chamber 30 to be delivered into the discharge-side tank part 28. At this time, the suction-side check valve 32 is kept closed; therefore, no liquid flows into the suction-side tank part 26 from the pump chamber 30. In this way, the expansion and contraction of the volume of the pump chamber 30 are repeated in response to the vibration of the diaphragm vibrator 18, thereby allowing the liquid to be sucked from the suction port 20 and discharged from the discharge port 22.

The housing 16 comprises a first housing part 36, a second housing part 38, and a third housing part 40, which are each formed in a plate-like shape as a whole. The first housing part 36 and the second housing part 38 are temporarily secured to each other with a screw 42 (FIGS. 1 and 2) inserted from the first housing part 36. The third housing part 40 is stacked over the temporarily secured first and second housing parts 36 and 38 in such a manner that the second housing part 38 is sandwiched between the first housing part 36 and the third housing part 40. In this state, four screws (not shown) are inserted into the housing 16 from the third housing part 40 side and threadedly engaged with the first housing part 36, so that the first housing part 36, the second housing part 38, and the third housing part 40 are securely connected each other. The diaphragm vibrator 18 is held being sandwiched between the second housing part 38 and the third housing part 40.

The first housing part 36 has a first suction-side tank recess 26*a* and a first discharge-side tank recess 28*a*, each of which is open toward the second housing part 38. The second housing part 38 has a second suction-side tank recess 26*b* and a second discharge-side tank recess 28*b*, each of which is open toward the first housing part 36. The suction-side tank part 26 is formed by the first suction-side tank recess 26*a* and the second suction-side tank recess 26*b*, which face each other, and the discharge-side tank part 28 is formed by the first discharge-side tank recess 28*a* and the second discharge-side tank recess 28*b*, which face each other. The second housing part 38 is further formed with a pump chamber recess 30*a* open toward the third housing part 40, suction-side communicating passages 44 providing communication between the second suction-side tank recess 26*b* and the pump chamber recess 30*a*, and discharge-side communicating passages 46 providing communication between the second discharge-side tank recess 28*b* and the pump chamber recess 30*a*. The above-described suction-side check valve 32 is disposed to cover and close open ends 44*b* of the suction-side communicating passages 44 open to the pump chamber 30. When the pressure in the pump chamber 30 decreases, the portion of the suction-side check valve 32 covering the open ends 44*b* is deformed to separate from the open ends 44*b*, resulting in the open ends 44*b* being open. The discharge-side check valve 34 is disposed to cover and close open ends 46*a* of the discharge-side communicating passages 46 open to the second discharge-side tank recess 28*b*. When the pressure in the pump chamber 30 increases, the portion of the discharge-side check valve 34 covering the open ends 46*a* is deformed to separate from the open ends 46*a*, resulting in the open ends 46*a* being open. The pump chamber 30 comprises the pump chamber recess 30*a*, which is formed in the second housing part 38, and the diaphragm vibrator 18.

As will be clear from FIG. 4, the discharge-side tank part 28 has a first inner wall surface 28*c* and a second inner wall surface 28*d* facing each other in the horizontal direction (left-right direction as seen in FIG. 4) in the installed position of the liquid pump 10. The first inner wall surface 28*c* is a bottom surface of the first discharge-side tank recess 28*a*, which is formed in the first housing part 36, and the second inner wall surface 28*d* is a bottom surface of the second discharge-side tank recess 28*b*, which is formed in the second housing part 38. The first inner wall surface 28*c* is formed with the discharge port 22, and the second inner wall surface 28*d* is formed with the open ends 46*a* of the discharge-side communicating passage 46. The discharge port 22 and the discharge-side communicating passages 46 are disposed at respective positions overlapping each other as seen in the horizontal direction below the center position in the vertical direction of the discharge-side tank part 28. Accordingly, the space in the discharge-side tank part 28 above the discharge port 22 and the discharge-side communicating passages 46 is wider than the space therebelow. In addition, a circular cylindrical partition 48 projects horizontally from the second inner wall surface 28*d* toward the first inner wall surface 28*c* while surrounding the open ends 46*a*. The circular cylindrical partition 48 projects halfway to the first inner wall surface 28*c* in the discharge-side tank part 28 so that a gap is provided between the circular cylindrical partition 48 and the first inner wall surface 28*c*.

The suction-side tank part 26 also has a structure similar to that of the discharge-side tank part 28. That is, the suction-side tank part 26 has a first inner wall surface 26*c* and a second inner wall surface 26*d* facing each other in the horizontal direction in the installed position of the liquid pump 10. The first inner wall surface 26*c* is a bottom surface of the first suction-side tank recess 26*a*, which is formed in the first housing part 36, and the second inner wall surface 26*d* is a bottom surface of the second suction-side tank recess 26*b*, which is formed in the second housing part 38. The first inner wall surface 26*c* is formed with the suction port 20, and the second inner wall surface 26*d* is formed with open ends 44*a* of the suction-side communicating passages 44. The suction port 20 and the suction-side communicating passages 44 are disposed at respective positions overlapping each other as seen in the horizontal direction below the center position in the vertical direction of the suction-side tank part 26. Accordingly, the space in the suction-side tank part 26 above the suction port 20 and the suction-side communicating passages 44 is wider than the space therebelow. In addition, a circular cylindrical partition 50 projects horizontally from the second inner wall surface 26*d* toward the first inner wall surface 26*c* while surrounding t the open ends 44*a*. The circular cylindrical partition 50 projects halfway to the first inner wall surface 26*c* in the suction-side tank part 26 so that a gap is provided between the circular cylindrical partition 50 and the first inner wall surface 26*c*.

Figure 5:
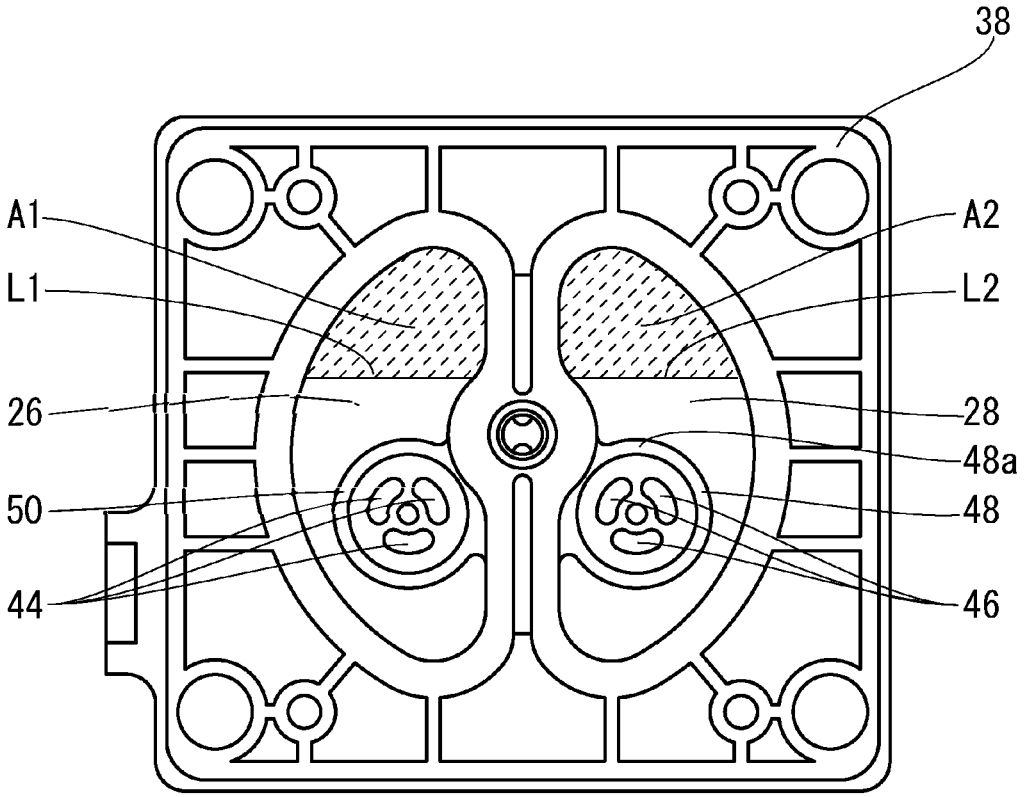
FIG. 5 is a front view of a second housing of the liquid pump shown in FIG. 1.

The suction-side tank part 26 and discharge-side tank part 28 each have, as shown in FIG. 5, a semicircular shape inside of which there is provided with a somewhat recessed portion, and are configured to be bilaterally symmetrical with respect to each other.

When the diaphragm vibrator 18 is vibrated by applying an alternating-current voltage thereto, liquid is sucked in from the suction port 20, as has been described above, and the suction-side tank part 26 and the discharge-side tank part 28 are gradually filled with the liquid. When the suction-side tank part 26 and the discharge-side tank part 28 have been filled with the liquid to a certain extent, however, the liquid surface will not rise any further, and, as shown in FIG. 5, air pools A1 and A2 are formed in the upper spaces of the suction- and discharge-side tank parts 26 and 28, respectively. As shown in FIG. 4, the circular cylindrical partition 48 in the discharge-side tank part 28 is disposed to be below the air pool A2 formed at this time, and the circular cylindrical partition 48 is configured such that a portion 48*a* of the circular cylindrical partition 48 which is located above the open ends 46*a* of the discharge-side communicating passages 46 covers the open ends 46*a* as seen from the air pool A2 side. That is, the portion 48*a* is located between the open ends 46*a* of the discharge-side communicating passages 46 and the air pool A2.

The flow rate of liquid discharged from the discharge port 22 can be increased either by increasing the voltage of alternating-current voltage to be applied to the diaphragm vibrator 18 to thereby increase the amplitude of the diaphragm vibrator 18 or by increasing the frequency of the alternating-current voltage to thereby decrease the period of vibration of the diaphragm vibrator 18. The liquid pump 10 is usually driven at a frequency of about from 20 Hz to 120 Hz. If the vibration frequency is increased in a liquid pump using a vibrator of the type described above, a high-frequency pressure vibration may occur particularly in the discharge-side tank part, and the liquid surface at the interface between the liquid and the air pool may vibrate violently, causing bubbles to form. When the liquid pump 10 is driven at a frequency of 100 Hz or higher, bubbles may also be formed at the liquid surface L2. In the conventional liquid pump, bubbles formed in this way diffuse into the liquid to reach the neighborhood of the discharge port and are discharged out from the discharge port, together with the liquid. In contrast thereto, the liquid pump 10 is configured such that at least a part of the circular cylindrical partition 48 is positioned between the discharge-side communicating passages 46 and the air pool A2; therefore, bubbles formed as stated above are suppressed from diffusing to below the at least a part of the circular cylindrical partition 48 and eventually being discharged from the discharge port 22. Accordingly, there is substantially no possibility that the air in the air pool A2 is discharged even if the liquid pump 10 is driven at a relatively high frequency, and the size of the air pool A2 can be kept constant. Thus, it is possible to prevent a reduction in the discharge capacity of the pump due to a decrease in size of the air pool A2.

It should be noted that there may be various reasons why the circular cylindrical partition 48 can advantageously prevent air discharge, but the most significant reason may be that the circular cylindrical partition 48 serves as an obstacle physically preventing the downward movement of generated bubbles. When there is no circular cylindrical partition 48, the liquid flowing into the discharge-side tank part 28 from the discharge-side communicating passages 46 is forced to change its flow direction so as to flow along the second inner wall surface 28*d* of the discharge-side tank part 28 by the discharge-side check valve 34. Consequently, a flow directed upward from the discharge-side communicating passages 46 is formed. When reaching the liquid surface L2, the upward flow of liquid changes its course toward the first inner wall surface 28*c*, and the liquid further flows downward along the first inner wall surface 28*c*. Accordingly, it is conceivable that bubbles formed in the vicinity of the liquid surface L2 are carried downward along the first inner wall surface 28*c* by the flow of liquid to reach the discharge port 22. In contrast to this, the liquid pump 10 according to the invention of this application is provided with the circular cylindrical partition 48 to prevent the above-described upward flow of liquid along the second inner wall surface 28*d*, thereby allowing the liquid to flow from the discharge-side communicating passage 46 directly toward the discharge port 22. Accordingly, it is conceivable that because a flow of liquid carrying bubbles and moving downward from the liquid surface L2 is unlikely to occur, downward diffusion of bubbles is suppressed, and the air in the air pool A2 is prevented from being discharged. Further, it is conceivable that because vibration of the liquid released from the open ends 46*a* of the discharge-side communicating passages 46 once collides with the circular cylindrical partition 48, the vibration is prevented from directly reaching the liquid surface L2, and this makes it possible, advantageously, to suppress the formation of bubbles itself.

The invention of this application is not limited to the above-described embodiment but can be modified in a variety of ways. For example, the cylindrical partition 48 of the discharge-side tank part 28 may be formed in a shape other than the circular cylindrical shape, e.g. a square cylindrical shape. The cylindrical partition 48 may also be replaced with a flat plate-shaped partition extending horizontally straight at a position above the discharge-side communicating passages 46. The partition is only required to be arranged such that at least a part of thereof is positioned above the discharge port 22 and the open ends 46*a* of the discharge-side communicating passages 46 so as to cover the open ends 46*a* as seen from the air pool A2 side. As long as this requirement is met, the partition may have a shape other than cylindrical shapes and flat plate-like shapes. Further, the vibrating wall part, which is a part of a wall defining the pump chamber 30, may be formed by an actuator other than the diaphragm vibrator 18 having piezoelectric elements. Further, the circular cylindrical partition 50 in the suction-side tank part 26 is not necessarily needed because it is, actually, not very likely that bubbles will be formed at the liquid surface L1 in the suction-side tank part

26. When the stability of suction performance does not matter much, the suction-side tank part 26 may be configured so that no air pool A1 will be formed. Alternatively, the suction-side tank part 26 per se may be eliminated.

Liquid pump 10; suction nozzle 12; discharge nozzle 14; housing 16; bottom surface 16*a*; top surface 16*b*; diaphragm vibrator 18; piezoelectric element 18*a*; suction port 20; discharge port 22; screw mounting hole 24; suction-side tank part 26; first suction-side tank recess 26*a*; second suction-side tank recess 26*b*; discharge-side tank part 28; first discharge-side tank recess 28*a*; second discharge-side tank recess 28*b*; first inner wall surface 28*c*; second inner wall surface 28*d*; pump chamber 30; pump chamber recess 30*a*; suction-side check valve 32; discharge-side check valve 34; first housing part 36; second housing part 38; third housing part 40; screw 42; suction-side communicating passage 44; open end 44*a* (discharge-side tank part 28 side end); opening 44*b* (pump chamber 30 side end); discharge-side communicating passage 46; open end 46*a*; circular cylindrical partition 48; portion 48*a* located above open end 46*a*; circular cylindrical partition 50; air pools A1 and A2; liquid surfaces L1 and L2.

What is claimed is:

1. A liquid pump comprising:

a suction port sucking a liquid;

a pump chamber communicating with the suction port, the pump chamber being defined by a wall, a part of which is a vibrating wall part vibratable to dynamically change a volume of the pump chamber;

a discharge-side communicating passage extending from the pump chamber;

a discharge-side tank part communicating with the pump chamber through the discharge-side communicating passage to store the liquid delivered from the pump chamber, the discharge-side tank part having a shape elongated in a vertical direction in an installed position of the liquid pump;

a discharge-side check valve disposed between the discharge-side tank part and the pump chamber to allow passage of fluid therethrough from the pump chamber toward the discharge-side tank part but prevent passage of fluid therethrough from the discharge-side tank part toward the pump chamber; and a discharge port discharging the liquid from the discharge-side tank part;

wherein the liquid is sucked in from the suction port and discharged from the discharge port in response to vibration of the vibrating wall part;

the discharge-side tank part having an inner wall surface defining an inner space of the discharge-side tank part, the inner wall surface including the discharge port and an open end of the discharge-side communicating passage, the discharge-side tank part being configured such that an air pool is formed in the inner space of the discharge-side tank part above the open end of the discharge-side communicating passage and the discharge port;

the liquid pump further comprising:

a partition projecting from the inner wall surface in the discharge side tank part in a horizontal direction in the installed position of the liquid pump such that at least a part of the partition is positioned between the open end of the discharge-side communicating passage and the air pool;

wherein the inner wall surface includes a first inner wall surface and a second inner wall surface facing each other in the horizontal direction, the first inner wall surface including the discharge port, the second inner wall surface including the open end of the discharge-side communicating passage, the discharge port and the open end of the discharge-side communicating passage disposed at respective positions overlapping each other in the horizontal direction and facing each other; and the partition projecting from the second inner wall surface toward the first inner wall surface in the discharge-side tank part, wherein in the vertical direction in the installed position of the liquid pump, a center point of the discharge-side check valve is below a center position of the discharge-side tank part.

2. The liquid pump of claim 1, wherein a gap is provided between the partition and the first inner wall surface.

3. The liquid pump of claim 2, wherein the partition is a cylindrical partition projecting from the second inner wall surface so as to surround the open end of the discharge-side communicating passage.

4. The liquid pump of claim 1, wherein the discharge-side communicating passage includes a plurality of the discharge-side communicating passages, and each open end of the plurality of the discharge-side communicating passages and the discharge port are disposed entirely below the center position in the vertical direction of the discharge-side tank part.

5. The liquid pump of claim 1, wherein the open end of the discharge-side communicating passage and the discharge port are disposed below the center position in a vertical direction of the discharge-side tank part.

6. The liquid pump of claim 2, wherein the open end of the discharge-side communicating passage and the discharge port are disposed below the center position in a vertical direction of the discharge-side tank part.

7. The liquid pump of claim 3, wherein the open end of the discharge-side communicating passage and the discharge port are disposed below the center position in a vertical direction of the discharge-side tank part.

8. The liquid pump of claim 1, further comprising:

a housing comprising a first housing part, a second housing part, and a third housing part being stacked on each other in such a manner that the second housing part is sandwiched between the first housing part and the third housing part;

the first housing part having the suction port and the discharge port and further having a first discharge-side tank recess having a bottom surface defined by the first inner wall surface, the first discharge-side tank recess being open toward the second housing part;

the second housing part having a second discharge-side tank recess having a bottom surface defined by the second inner wall surface, the second discharge-side tank recess being open toward the first housing part, the second housing part further having a pump chamber recess on a side thereof opposite to a side having the second discharge-side tank recess, the pump chamber recess being open toward the third housing part;

the vibrating wall part being a diaphragm vibrator held between the second housing part and the third housing part so as to cover an opening portion of the pump chamber recess; and the discharge-side tank part being formed by the first discharge-side tank recess and the second discharge-side tank recess.

9. The liquid pump of claim 2, further comprising:

a housing comprising a first housing part, a second housing part, and a third housing part being stacked on each other in such a manner that the second housing part is sandwiched between the first housing part and the third housing part;

the first housing part having the suction port and the discharge port and further having a first discharge-side tank recess having a bottom surface defined by the first inner wall surface, the first discharge-side tank recess being open toward the second housing part;

the second housing part having a second discharge-side tank recess having a bottom surface defined by the second inner wall surface, the second discharge-side tank recess being open toward the first housing part, the second housing part further having a pump chamber recess on a side thereof opposite to a side having the second discharge-side tank recess, the pump chamber recess being open toward the third housing part;

the vibrating wall part being a diaphragm vibrator held between the second housing part and the third housing part so as to cover an opening portion of the pump chamber recess; and the discharge-side tank part being formed by the first discharge-side tank recess and the second discharge-side tank recess.

10. The liquid pump of claim 3, further comprising:

a housing comprising a first housing part, a second housing part, and a third housing part being stacked on each other in such a manner that the second housing part is sandwiched between the first housing part and the third housing part;

the first housing part having the suction port and the discharge port and further having a first discharge-side tank recess having a bottom surface defined by the first inner wall surface, the first discharge-side tank recess being open toward the second housing part;

the second housing part having a second discharge-side tank recess having a bottom surface defined by the second inner wall surface, the second discharge-side tank recess being open toward the first housing part, the second housing part further having a pump chamber recess on a side thereof opposite to a side having the second discharge-side tank recess, the pump chamber recess being open toward the third housing part;

the vibrating wall part being a diaphragm vibrator held between the second housing part and the third housing part so as to cover an opening portion of the pump chamber recess; and the discharge-side tank part being formed by the first discharge-side tank recess and the second discharge-side tank recess.

11. The liquid pump of claim 4, further comprising a housing comprising a first housing part, a second housing part, and a third housing part being stacked on each other in such a manner that the second housing part is sandwiched between the first housing part and the third housing part;

the first housing part having the suction port and the discharge port and further having a first discharge-side tank recess having a bottom surface defined by the first inner wall surface, the first discharge-side tank recess being open toward the second housing part;

the second housing part having a second discharge-side tank recess having a bottom surface defined by the second inner wall surface, the second discharge-side tank recess being open toward the first housing part, the second housing part further having a pump chamber recess on a side thereof opposite to a side having the second discharge-side tank recess, the pump chamber recess being open toward the third housing part;

the vibrating wall part being a diaphragm vibrator held between the second housing part and the third housing part so as to cover an opening portion of the pump chamber recess; and the discharge-side tank part being formed by the first discharge-side tank recess and the second discharge-side tank recess.

12. The liquid pump of claim 5, further comprising:

a housing comprising a first housing part, a second housing part, and a third housing part being stacked on each other in such a manner that the second housing part is sandwiched between the first housing part and the third housing part;

the first housing part having the suction port and the discharge port and further having a first discharge-side tank recess having a bottom surface defined by the first inner wall surface, the first discharge-side tank recess being open toward the second housing part;

the second housing part having a second discharge-side tank recess having a bottom surface defined by the second inner wall surface, the second discharge-side tank recess being open toward the first housing part, the second housing part further having a pump chamber recess on a side thereof opposite to a side having the second discharge-side tank recess, the pump chamber recess being open toward the third housing part;

the vibrating wall part being a diaphragm vibrator held between the second housing part and the third housing part so as to cover an opening portion of the pump chamber recess; and the discharge-side tank part being formed by the first discharge-side tank recess and the second discharge-side tank recess.

13. The liquid pump of claim 6, further comprising:

a housing comprising a first housing part, a second housing part, and a third housing part being stacked on each other in such a manner that the second housing part is sandwiched between the first housing part and the third housing part;

the first housing part having the suction port and the discharge port and further having a first discharge-side tank recess having a bottom surface defined by the first inner wall surface, the first discharge-side tank recess being open toward the second housing part;

the second housing part having a second discharge-side tank recess having a bottom surface defined by the second inner wall surface, the second discharge-side tank recess being open toward the first housing part, the second housing part further having a pump chamber recess on a side thereof opposite to a side having the second discharge-side tank recess, the pump chamber recess being open toward the third housing part;

the vibrating wall part being a diaphragm vibrator held between the second housing part and the third housing part so as to cover an opening portion of the pump chamber recess; and the discharge-side tank part being formed by the first discharge-side tank recess and the second discharge-side tank recess.

14. The liquid pump of claim 7, further comprising:

a housing comprising a first housing part, a second housing part, and a third housing part being stacked on each other in such a manner that the second housing part is sandwiched between the first housing part and the third housing part;

the first housing part having the suction port and the discharge port and further having a first discharge-side tank recess having a bottom surface defined by the first inner wall surface, the first discharge-side tank recess being open toward the second housing part;

the second housing part having a second discharge-side tank recess having a bottom surface defined by the second inner wall surface, the second discharge-side tank recess being open toward the first housing part, the second housing part further having a pump chamber recess on a side thereof opposite to a side having the second discharge-side tank recess, the pump chamber recess being open toward the third housing part;

the vibrating wall part being a diaphragm vibrator held between the second housing part and the third housing part so as to cover an opening portion of the pump chamber recess; and the discharge-side tank part being formed by the first discharge-side tank recess and the second discharge-side tank recess.

15. The liquid pump of claim 1, further comprising:

a suction-side tank part disposed between the suction port and the pump chamber to store the liquid sucked in from the suction port;

a suction-side communicating passage providing communication between the suction-side tank part and the pump chamber; and a suction-side check valve disposed to cover an open end of the suction-side communicating passage open to the pump chamber from a pump chamber side, the suction-side check valve being configured to allow passage of fluid therethrough from the suction-side tank part toward the pump chamber but prevent passage of fluid therethrough from the pump chamber toward the suction-side tank part;

the suction-side tank part having a first inner wall surface and a second inner wall surface facing each other in the horizontal direction in the installed position of the liquid pump, the first inner wall surface of the suction-side tank part including the suction port, the second inner wall surface of the suction-side tank part including an open end of the suction-side communicating passage open to the suction-side tank part, the suction-side tank part being configured such that an air pool is formed in a space in the suction-side tank part above the open end and the suction port;

the liquid pump further comprising:

a partition projecting from the second inner wall surface of the suction-side tank part toward the first inner wall surface of the suction-side tank part such that at least a part of the partition is positioned between the open end of the suction-side communicating passage and the air pool.

16. The liquid pump of claim 2, further comprising:

a suction-side tank part disposed between the suction port and the pump chamber to store the liquid sucked in from the suction port;

a suction-side communicating passage providing communication between the suction-side tank part and the pump chamber; and a suction-side check valve disposed to cover an open end of the suction-side communicating passage open to the pump chamber from a pump chamber side, the suction-side check valve being configured to allow passage of fluid therethrough from the suction-side tank part toward the pump chamber but prevent passage of fluid therethrough from the pump chamber toward the suction-side tank part;

the suction-side tank part having a first inner wall surface and a second inner wall surface facing each other in the horizontal direction in the installed position of the liquid pump, the first inner wall surface of the suction-side tank part including the suction port, the second inner wall surface of the suction-side tank part including an open end of the suction-side communicating passage open to the suction-side tank part, the suction-side tank part being configured such that an air pool is formed in a space in the suction-side tank part above the open end and the suction port;

the liquid pump further comprising:

a partition projecting from the second inner wall surface of the suction-side tank part toward the first inner wall surface of the suction-side tank part such that at least a part of the partition is positioned between the open end of the suction-side communicating passage and the air pool.

17. The liquid pump of claim 4, further comprising:

a suction-side tank part disposed between the suction port and the pump chamber to store the liquid sucked in from the suction port;

a suction-side communicating passage providing communication between the suction-side tank part and the pump chamber; and a suction-side check valve disposed to cover an open end of the suction-side communicating passage open to the pump chamber from a pump chamber side, the suction-side check valve being configured to allow passage of fluid therethrough from the suction-side tank part toward the pump chamber but prevent passage of fluid therethrough from the pump chamber toward the suction-side tank part;

the suction-side tank part having a first inner wall surface and a second inner wall surface facing each other in the horizontal direction in the installed position of the liquid pump, the first inner wall surface of the suction-side tank part including the suction port, the second inner wall surface of the suction-side tank part including an open end of the suction-side communicating passage open to the suction-side tank part, the suction-side tank part being configured such that an air pool is formed in a space in the suction-side tank part above the open end and the suction port;

the liquid pump further comprising:

a partition projecting from the second inner wall surface of the suction-side tank part toward the first inner wall surface of the suction-side tank part such that at least a part of the partition is positioned between the open end of the suction-side communicating passage and the air pool.

18. The liquid pump of claim 4, further comprising:

a suction-side tank part disposed between the suction port and the pump chamber to store the liquid sucked in from the suction port;

a suction-side communicating passage providing communication between the suction-side tank part and the pump chamber; and a suction-side check valve disposed to cover an open end of the suction-side communicating passage open to the pump chamber from a pump chamber side, the suction-side check valve being configured to allow passage of fluid therethrough from the suction-side tank part toward the pump chamber but prevent passage of fluid therethrough from the pump chamber toward the suction-side tank part;

the suction-side tank part having a first inner wall surface and a second inner wall surface facing each other in the horizontal direction in the installed position of the liquid pump, the first inner wall surface of the suction-side tank part including the suction port, the second inner wall surface of the suction-side tank part including an open end of the suction-side communicating passage open to the suction-side tank part, the suction-side tank part being configured such that an air pool is formed in a space in the suction-side tank part above the open end and the suction port;

the liquid pump further comprising:

a partition projecting from the second inner wall surface of the suction-side tank part toward the first inner wall surface of the suction-side tank part such that at least a part of the partition is positioned between the open end of the suction-side communicating passage and the air pool.

* * * * *